US011212627B2

(12) United States Patent
Gottschalk et al.

(10) Patent No.: US 11,212,627 B2
(45) Date of Patent: Dec. 28, 2021

(54) HEARING DEVICE AND METHOD FOR OPERATING A HEARING DEVICE

(71) Applicant: SIVANTOS PTE. LTD., Singapore (SG)

(72) Inventors: Georg Gottschalk, Erlangen (DE); Dietmar Lommel, Poxdorf (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/882,931

(22) Filed: May 26, 2020

(65) Prior Publication Data

US 2020/0374642 A1 Nov. 26, 2020

(30) Foreign Application Priority Data

May 24, 2019 (DE) ..... 102019207680

(51) Int. Cl.
*H04R 25/00* (2006.01)
*H04R 1/10* (2006.01)

(52) U.S. Cl.
CPC ..... *H04R 25/652* (2013.01); *H04R 1/1041* (2013.01); *H04R 25/60* (2013.01); *H04R 2225/025* (2013.01); *H04R 2225/61* (2013.01); *H04R 2460/11* (2013.01)

(58) Field of Classification Search
CPC .... H04R 25/652; H04R 1/1041; H04R 25/60; H04R 2225/025; H04R 2225/61; H04R 2460/11
See application file for complete search history.

(56) References Cited

U.S. PATENT DOCUMENTS

| | | | | |
|---|---|---|---|---|
| 10,887,705 | B2 * | 1/2021 | Lafort | H01F 7/064 |
| 2011/0216929 | A1 | 9/2011 | Jang et al. | |
| 2014/0169603 | A1 * | 6/2014 | Sacha | H04R 25/60 381/324 |
| 2019/0116436 | A1 | 4/2019 | Lawand et al. | |
| 2019/0208343 | A1 | 7/2019 | Monti et al. | |
| 2019/0246219 | A1 | 8/2019 | Lafort et al. | |
| 2020/0288251 | A1 | 9/2020 | Kuipers | |

FOREIGN PATENT DOCUMENTS

| | | | |
|---|---|---|---|
| DE | 102018221726 | A1 | 7/2019 |
| EP | 3471433 | A2 | 4/2019 |
| EP | 3567873 | A1 | 11/2019 |
| WO | 2019052714 | A1 | 3/2019 |
| WO | 2019052715 | A1 | 3/2019 |

* cited by examiner

*Primary Examiner* — Andrew L Sniezek
(74) *Attorney, Agent, or Firm* — Laurence A. Greenberg; Werner H. Sterner; Ralph E. Locher

(57) ABSTRACT

A hearing device, such as a receiver-in-canal hearing aid, has a receiver unit with a receiver, and a control unit. The control unit is connected to the receiver unit via two activation lines to activate the receiver. In addition, a further component, such as a controllable ventilation element, is located in the receiver unit, and the further component is likewise activated via the activation lines by a control signal which is output by the control unit.

16 Claims, 2 Drawing Sheets

HEARING DEVICE AND METHOD FOR OPERATING A HEARING DEVICE

CROSS-REFERENCE TO RELATED APPLICATION

This application claims the priority, under 35 U.S.C. § 119, of German patent application DE 10 2019 207 680, filed May 24, 2019; the prior application is herewith incorporated by reference in its entirety.

BACKGROUND OF THE INVENTION

Field of the Invention

The invention relates to a hearing device, such as a hearing aid, and to a method for operating a hearing device.

Hearing devices are understood in the present context to be, preferably but not exclusively, devices that aid in hearing. Such hearing devices devices, hereinafter referred to as hearing aids, are portable hearing devices used by the hearing impaired. In order to meet the numerous individual needs, there are different types of hearing aids, i.e. behind the ear hearing aids (BTE), hearing aids with external receivers (RIC: receiver in the canal) and in the ear hear aids (ITE), e.g. concha hearing aids or completely in canal hearing aids (CIC). These hearing aids, listed by way of example, are worn on the outer ear or in the ear canal. Furthermore, there are also bone conduction hearing aids, implantable, or vibrational tactile hearing aids available on the market. The stimulation of the impaired hearing takes place therewith either mechanically or electrically.

Hearing aids basically have an input converter, a booster, and an output converter as the substantial components. The input converter is normally a receiving transducer, e.g. a microphone, and/or an electromagnetic receiver, e.g. and induction coil. The output converter is usually implemented as an acoustic converter, e.g. a miniature loudspeaker, or as an electromechanical converter, e.g. a bone conduction receiver. The booster is normally integrated in a signal processor.

This basic construction is shown in FIG. 1 in an exemplary behind the ear hearing aid. One or more microphones 2 for receiving sounds in the environment are integrated in a hearing aid housing 1 that is worn behind the hear. A signal processing unit, or signal processor 3, likewise integrated in the hearing aid housing 1, processes and amplifies the microphone signals. The output signal from the signal processor 3 is sent to a loudspeaker, or receiver 4, that outputs an acoustic signal. The sound is then transmitted via a sound tube, which is anchored in the ear canal with an earmold, to the eardrum of the hearing aid wearer. The energy source for the hearing aid, and in particular for the signal processor 3, is a battery 5, likewise integrated in the hearing aid housing 1.

An adaptation of hearing aids to different hearing impairments through different powers and to different customer requirements, as well as the demands of the customers for increasingly smaller structural sizes, forces the hearing aid manufacturer to provide a broad range of hearing aids with different scopes of function for different performance levels. This results in numerous hearing aids of different sizes that can be tailored individually to hearing impairments and customer requirements.

The aforementioned RIC hearing aids are multi-part hearing aids, in which the receiver is located in its own receiver unit, and the signal processor is located in a separate unit.

The two units are electrically connected to one another via signal lines, to activate the receiver.

SUMMARY OF THE INVENTION

It is accordingly an object of the invention to provide a hearing device, which overcomes the above-mentioned and other disadvantages of the heretofore-known devices and methods of this general type and which provides for a hearing device, in particular an RIC hearing aid, with expanded functions, and a also a method for operating a hearing aid.

With the above and other objects in view there is provided, in accordance with the invention, a hearing device, comprising:

a receiver unit with a receiver; and a control unit;

two activation lines connecting the control unit with the receiver unit for transmitting a control signal; and a further component disposed in the receiver unit and connected to the control unit via the two activation lines.

In other words, the objects of the invention are achieved by a hearing device (e.g. a hearing aid) that includes a receiver unit with a receiver, and a control unit. The control unit is connected to the receiver unit via two activation lines for transmitting a control signal for activating the receiver. There is also provided a further component in the receiver unit, which is likewise connected to the receiver unit via the two activation lines, and is activated via the two activation lines.

It is of particular importance that there is a further component in the receiver unit, and that both units are activated via the shared activation lines. The activation lines are usually insulated electrical supply wires. As a result of the collective use of the activation lines for both components, it is easier to form the connections, in particular, the wiring is less complex. At the same time, the scope of functions of the receiver unit is increased by the further (electric) component.

Various operating modes are set via the control unit through different activations of the components.

The hearing aid is specifically a multi-part hearing aid in which the receiver unit is an independent unit with its own housing, which is separated from a further unit, which likewise has its own housing. This further unit shall be referred to as the base unit in the following. The two units are connected to one another via the activation lines, which run through the same tube, for example. This base unit typically contains the actual signal processor, a microphone, and the aforementioned control unit. The control unit is part of the signal processor, for example. The activation lines are typically connected to the base unit via a contact connector, specifically a plug-in connector. There is therefore a contact connector element in the base unit for establishing electrical contact with the activation lines. A socket with electrical contacts is frequently formed on a circuit board for this.

The hearing aid is preferably, but not necessarily, a hearing aid in which the signal processor is also configured to compensate for hearing impairments of a person in a targeted manner, e.g. through a frequency dependent amplification of a sound signal received from a microphone adapted to the hearing impairment.

The control unit preferably has a booster amplifier, or is configured as such. Both the receiver as well as the further components are supplied with electricity via the activation lines via this shared booster amplifier. The booster amplifier is used periodically to amplify an electrical signal sent to the receiver in that the electrical signal is converted to an acoustic sound signal. There are typically no further components between the receiver and the booster amplifier for amplifying the signal. The booster amplifier is preferably configured to supply electricity of at least 1 mW, preferably at least 10 mW, and by way of example, of up to 20 mW or up to 30 mW. The receiver and/or the further components are therefore supplied with and consume power.

This embodiment therefore results in the particular advantage that the power supplied by the booster amplifier is available for both the receiver and the further components.

In particular, the hearing aid is in the form of a receiver in the canal hearing aid (RIC hearing aid). Alternatively, the hearing aid is configured in general as a device that can be worn in or on the ear that produces a sound stimulus, e.g. as an (in ear) headphone, headset, etc.

An RIC hearing aid is understood to be a hearing aid that is configured such that when it is used, the receiver unit, with the receiver, is specifically located in an ear canal of the user, while all of the further components, e.g. the control unit, a signal processor, and a microphone for receiving a sound outside the ear canal that is to be amplified, are preferably located outside the ear canal in a separate device unit, e.g. behind an ear of the user. The receiver unit and the separate device unit, which contains the control unit, are preferably connected by a tube to one another, in which the two activation lines for activating the receiver in the ear canal of the user are located.

The further component preferably forms an adjustable ventilation element. The further component in the form of an adjustable ventilation element is based on the idea that the coupling to the ear canal is frequently in the form of an open adaptation. An open adaptation is understood in this context to mean that the receiver unit is placed in the ear canal without forming a seal. This makes sense, in particular for slight and moderate hearing losses, because an occlusion—thus a sealing—of the ear canal would be noticeable to the user, and normally be regarded as disruptive.

In differing from low frequencies, with which normally no amplification is required and the direct sound is therefore sufficient, this is lacking, however, with non-acoustic input signals. In this regard, the sound of such non-acoustic input signals is perceived as thin and high-pitched. This compromises the quality, particularly when listening to music. The non-acoustic input signals are generally understood to preferably be electromagnetic input signals from the hearing aid, which are not received by the microphone. These include, e.g., signals received (wirelessly) from a corresponding receiver, e.g. from a telecoil in the hearing aid. The telecoil is preferably used to establish a wireless connection from the hearing aid to, e.g., a user's cellular telephone for telephoning, and/or, e.g., a wireless connection to an audio system in a church or theater. Furthermore, the non-acoustic input signal can also be a wireless reception (WLS reception) by means of a wireless close range communication system.

In particular in the latter case, that the acoustic output signal from the hearing aid is based on a non-acoustic input signal, closing the ear canal to improve the quality of the sound is advantageous, which is achieved with the controllable ventilation element. Furthermore, closing the ear canal has also proven to be advantageous when the acoustic output signal is based on an acoustic input signal (an input signal received by a microphone and converted). In particular in a so-called cocktail party situation, closing the ear canal is advantageous for the user. A cocktail party situation is understood to be an (acoustic) situation for the user containing numerous acoustic signal sources in his environment. These acoustic signal sources include people talking, or music playing from speakers.

These different, simultaneously active acoustic signal sources result in a situation that is unpleasant, in particular for a hearing impaired individual. The hearing aid, and in particular a directional effect of the microphone in the hearing aid, allows the user to "concentrate" on an acoustic signal source, e.g. a single conversational partner. If the ear canal is also closed, the direct sounds of other, in this case disruptive, acoustic signal sources, are more effectively dampened.

The ventilation element, e.g. a valve, is therefore activated via the activation line, and is switched, in particular, between two states (open and closed). The operating modes that can be set by the control unit are therefore, e.g., an open setting (valve is open) and a closed setting (valve is closed).

Other embodiments of the further components are also conceivable. The further component is thus not limited to an embodiment as a controllable ventilation element.

The further component contains the aforementioned valve, in particular, or is formed by this valve. Furthermore, the further component preferably contains an, in particular, magnetic switch unit. The switch unit can be switched between two states by means of the control signal transmitted via the activation lines. In particular, these are two stable switching states, such that the further component remains stable in the respective other switching state after receiving a switching signal. The switching is electromagnetic in particular. As such, a magnetic field is generated, in particular through the electric current supplied via the activation signal, which acts on the magnetic switch unit, such that it switches. A mechanical adjustment movement of a control element or closing element takes place in particular.

The receiver unit is preferably exclusively connected to the control unit via the two control lines—or via another line, referred to below as the selection line.

With conventional RIC hearing aids, the receiver unit, and therefore the receiver, is typically only connected via two activation lines. In some embodiments there is an additional line, which is connected, e.g., to a ground. As a result of the embodiment selected here, it is no longer necessary to alter the wiring of the connections, at least at the control unit, as was the case with previous designs.

The control signal is a pulsed control signal in particular. The control unit is therefore configured to generate and input such a pulsed control signal, and such a control signal is transmitted when the hearing aid is operating. The receiver and the further component are activated alternately via pulse modulation. The two components are therefore preferably activated via the modulation of the control signal.

The pulse modulation is a pulse-width modulation, by way of example.

A pulse-density modulation is preferably used. In this case, the sequence of the pulses of the same width at a high frequency changes in accordance with the fundamental low frequency, e.g. acoustic, signal. The number of pulses per time interval (density) therefore varies. The activation of receivers frequently takes place via a pulse-density modulated signal. Because a receiver is slow, due to its structure, and exhibits a low-pass effect, it automatically distinguishes the fundamental low frequency signal from the sequence of pulses.

In particular, a lower frequency, and thus a longer pulse duration in a pulse-density modulated signal, is used for activating the further component than the frequency used for activating the receiver. The receiver is activated in particular with a frequency in the MHz range (pulse duration of less than 1 μs).

A frequency of preferably less than 1 kHz and in particular less than 0.1 kHz is used to activate the further components. The pulse duration corresponding to this is therefore, e.g., preferably greater than 1 ms, e.g. 5 ms, and in particular greater than 10 ms, or in the range of 10 ms (5 ms to 20 ms). Therefore, a basically static signal is drawn on for activating the further component.

This embodiment is based on the consideration that the functioning of the receiver is ensured by the activation with the higher frequencies. At the same time, the further component is slow, such that the higher frequencies do not affect the further components and alter their states.

Furthermore, the low frequencies are selected such that the receiver and its functioning are not, or hardly, affected. Specifically, a membrane in the receiver remains in its state, and does not output an acoustic signal. Instead, the further component reacts to these low frequencies or long pulse durations.

In particular with the preferred example of the switching of a (magnetic) switch element between two states, the long pulse durations of e.g. 10 ms result in a sufficiently high (magnetic) effect, such that a switching can take place.

In a preferred further development, a filter is placed upstream of at least one of the two components, either the receiver or the further component, which filters out the (high frequency or low frequency) signals intended for the other component. Specifically, a high pass filter is connected upstream of the receiver, and/or a low pass filter is connected upstream of the further component. The filters are placed in particular immediately in front of the respective component in a branching of the control line, such that the filter only affects the activation signal for the respective component. The filter or the filters are therefore located in particular in the receiver unit.

Alternatively or additionally, there is a switch mechanism in the receiver unit, which is configured to switch on the receiver and/or the further component. In a first variation, it is therefore possible to also activate the further component, specifically to switch this component on, while the receiver is operating. According to a second variation, the switch mechanism is configured such that either the receiver or the further component is activated.

The switch mechanism is configured in particular such that when the receiver is operating in a first operating mode, it is electrically connected to the control unit, or in a second operating mode, the further component is electrically connected to the control unit.

The switch mechanism preferably has two switch elements. The switch mechanism is used to electrically connect either the receiver or the further component to the control unit. Each switch element is therefore located at the end of one of the two activation lines, in order to electrically connect either the receiver or the further component, which is preferably connected in parallel to the receiver, to the control unit via the activation lines, depending on the selected operating mode.

In general—depending on the switch mechanism—one of the two control lines serves as an input, while the other activation line serves as a return line to the control unit.

A simple selective connection of either the receiver or the further component to the control unit is achieved through the two switch elements. In addition, there is no more need for further activation lines for the further component, because the activation lines normally used for activating the receiver can also be used to activate the further component.

In order to activate the switch elements of the switch mechanism, the switch mechanism is preferably connected to the control unit via a further line, which is referred to below as the aforementioned selection line. An existing ground connection or ground line is preferably used as the reference potential, which preferably also serves as the ground line for other components. The ground line connects the receiver unit to a ground potential for the base unit. A separate ground line is therefore not explicitly necessary for the switch mechanism. The switch mechanism is therefore effectively connected, in particular with only one control line, to the control unit.

The selection line is preferably likewise located in the aforementioned tube that connects the control unit to the receiver unit, and in which the two activation lines are likewise located. This enables an activation of the two switch elements while—as specified above—the number of lines for activating the receiver and the further component is reduced in comparison with a separate activation. A separate activation is understood to mean that both the receiver and the additional components each have two individual activation lines, such that four activating lines lead from the control unit to the receiver unit, while in the embodiment according to the invention, only two or at most three control lines (two activation lines, one selection line) are needed. In addition, the embodiment according to the invention, with only two or three lines, is advantageous in this regard, because the number of electrical contacts is limited in the receiver unit and in the control unit, in particular with RIC hearing aids.

The receiver unit is therefore preferably connected to the control unit exclusively via the two activation lines, and potentially also via the selection line.

Alternatively to the use of a selection line, the desired operating mode and switching state is extracted from the control signal by a filtering thereof. The switch mechanism is therefore configured to filter the signal and activate the switch element accordingly.

The receiver unit contains no active components for signal evaluation in any of the embodiment variations. The receiver unit contains only passive components, aside from the receiver and the further component.

The control unit, in particular the aforementioned booster amplifier, preferably has numerous semiconductor switches, connected in the manner of an H-bridge. This booster amplifier forms a control element in general for activating the receiver, and is preferably also referred to as a drive unit. It is possible to generate an activation signal with such a control element, in the form of an H-bridge, which has a high current value and can therefore supply the necessary high level of power.

Furthermore, the control element in the form of an H-bridge is configured such that the electrical current can flow in two different directions through the receiver or the further component. Such a polarity reversal of the current is also referred to as polarity reversal capability, and such an operation of the H-bridge is referred to as a "push-pull operation." Both the driver capability as well as the polarity reversal capability of the control element configured as an H-bridge are characteristic of such control elements, which are used, for example, in RIC hearing aids.

The control element connected and thus configured as an H-bridge is preferably integrated on a chip. Such an embodiment has proven to be advantageous due to the advantageously small structural dimensions of circuit board circuits specifically for hearing aids.

The control unit is conveniently configured such that the further components can be activated with the same activation signal as the receiver. The further components are therefore activated by means of the control element in the form of an H-bridge in the control unit with the control signal that it generates. In other words, the control unit, and specifically the control signal, which is actually intended for the receiver, is used to activate the further components, aside from a potential amplitude and/or frequency transformation. Specifically when the further component is designed as a controllable ventilation element, requiring a strong current, this results in an advantage in the activation.

This embodiment is based—independently of the specific embodiment variation—on the idea that, as a result, the control unit is advantageously used for activating the further component. The control unit, which normally activates the receiver and contains the amplifier, has proven to be advantageous with regard to supplying a higher current pulse for activating the ventilation element. This therefore results in a multiple use of the control unit without placing additional components in the hearing aid. These additional components are understood to be components specifically necessary for an activation, i.e. for supplying an activation signal for the ventilation element. This embodiment is also advantageous, e.g., for in the ear hearing aids (ITE hearing aids).

The object of the invention is also achieved with a receiver unit for such a hearing aid as described above. The receiver unit in this case contains a receiver that is connected to a control unit in a hearing aid. The receiver unit is preferably the receiver unit described above in the framework of the description of the hearing aid.

With the above and other objects in view there is also provided, in accordance with the invention, a method for operating a hearing aid that contains a receiver unit with a receiver and a control unit, wherein the receiver is activated by the control unit. There is also a further component in the receiver unit. This is likewise activated via the shared activation lines and the control signal from the control unit transmitted therewith.

The receiver and the further components are preferably activated—as explained above—by means of a modulated, pulsed control signal, or alternatively via a switch device, in order to operate the hearing aid in different operating modes. The activation signal is supplied in this case in particular by the booster amplifier, which therefore supplies the necessary power for the receiver as well as for the further components.

The further component is preferably the controllable ventilation element, which is activated by the control unit with the activation signal. The activation signal is formed by a current pulse of sufficient length. Depending on the direction of the current, the controllable ventilation element is opened or closed.

Other features which are considered as characteristic for the invention are set forth in the appended claims.

The advantages and preferred embodiments listed with regard to the hearing aid can be applied analogously to the receiver unit and the method for operating the hearing aid, and vice versa. That is, although the invention is illustrated and described herein as embodied in hearing aid and method for operating a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
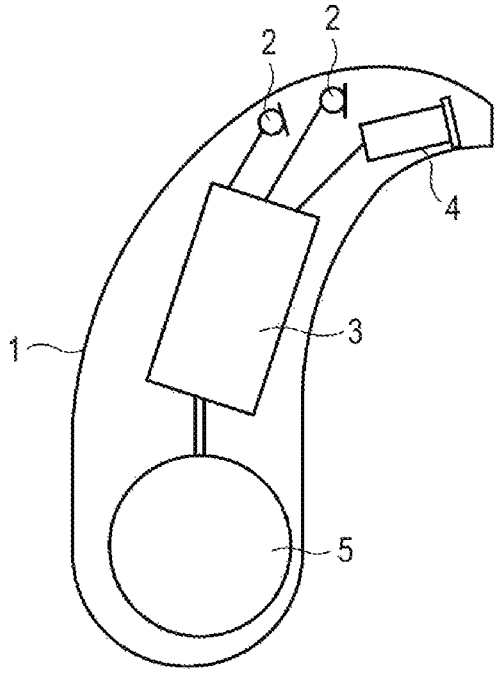
FIG. 1 shows the fundamental construction of a hearing aid according to the prior art.
Figure 2:
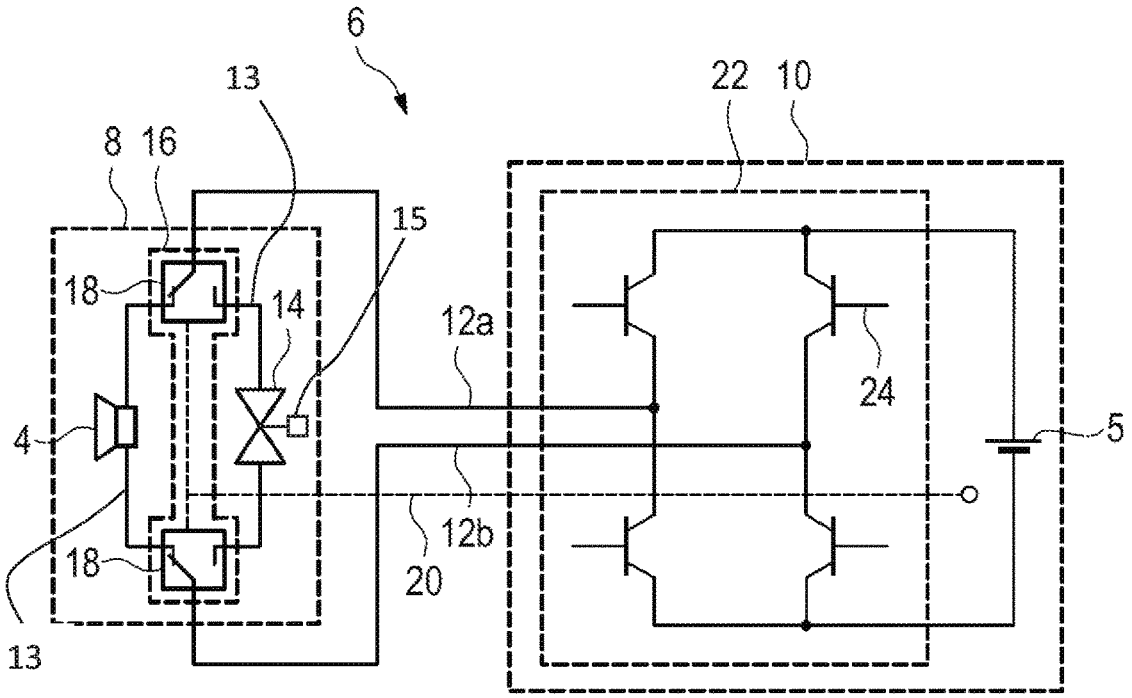
FIG. 2 shows a sketch of a circuit diagram for a hearing aid according to a first variation.
Figure 3:
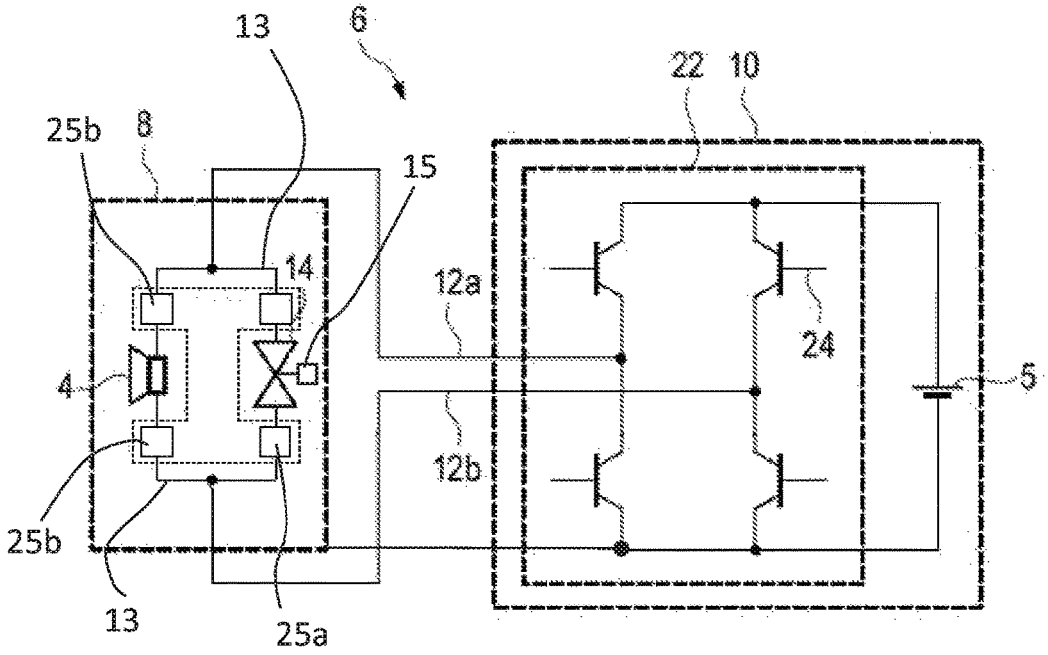
FIG. 3 shows a sketch of a circuit diagram according to a second variation.

Referring now to the figures of the drawing in detail and first, particularly, to FIGS. 2 and 3 thereof, each shows a sketch of a circuit diagram for a hearing aid 6 according to the invention, in particular an RIC hearing aid. The hearing aid 6 contains a receiver unit 8 that has a receiver 4. The hearing aid 6 also has a base unit with a control unit 10 located therein. The receiver unit 8 and the control unit 10 are contained in two separate units, not shown herein, each with its own housing.

The control unit 10 is connected to the receiver unit 8, and specifically to the receiver 4, via two activation lines 12*a*, 12*b* in this exemplary embodiment. The activation lines 12*a*, 12*b* are used by the control unit 10 to activate the receiver 4. The activation lines 12*a*, 12*b* typically lie in a shared tube, running from the base unit to the receiver unit 8.

The receiver unit 8 also contains a further component 14 in the form of a controllable ventilation element in the exemplary embodiment. Specifically, the further component 14 in the exemplary embodiments is configured as a (magnetic) valve, which can be switched between two states (open/closed). The valve has a corresponding switch unit 15 for this purpose.

Both the receiver 4 and the further component 14 are activated via the activation lines 12*a*, 12*b* when in operation. The receiver 4 and the further component 14 are connected in parallel in the exemplary embodiment. Starting from an end-side distributor node on one of the activation lines 12*a*, 12*b*, branches 13 lead in each case to a respective connection in the receiver 4 or the further component 14.

The control unit 10 contains a control element that is configured in the exemplary embodiment as a (booster) amplifier 22. The amplifier 22 has numerous semiconductor circuits 24, four semiconductor circuits 24 in the exemplary embodiment, which are connected in an H-bridge. The amplifier 22 provides the control signals for the receiver 4 as well as for the further components 14. The control signals are transmitted via the activation lines 12*a*, 12*b*. The power necessary for operating these components is provided by the shared amplifier 22 for both the receiver 4 as well as the further components 14.

Both the receiver 4 as well as the further component 14 are therefore activated and operated via the control signal. The embodiment of the amplifier 22 in the form of an H-bridge enables a reversal of the direction of current, thus forming a push-pull activation. The reversal of the current flow is used in particular to open and close the further component 14 in the form of a controllable ventilation element. The electrical current is provided by a battery 5.

Specifically, depending on the direction of the current, a magnetic control element in the switch unit 15, and thus the magnetic valve, are switched from a (stable) end position, e.g. open, to another (stable) end position, e.g. closed, in the exemplary embodiment.

There are different variations available for activating the receiver unit 8:

According to a first variation, which is illustrated in FIG. 2, the receiver unit 8 has a switch mechanism 16. This is configured such that when operating in a first operating mode, the receiver 4 is electrically connected to the control unit 10, and in a second operating mode, the further component 14 is electrically connected to the control unit 10. In other words, depending on the operating mode (either the first operating mode or the second operating mode), the receiver 4 or the further component 14 is electrically connected to the control unit 10 by means of the activation lines 12*a*, 12*b*.

In the preferred embodiment of the further component 14 as a ventilation element that can be switched between two states, only a short interruption of the activation of the receiver 4 is necessary, because the control signal only needs to be applied for the time required to switch to the further component.

In order to switch between the receiver 4 and the further component 14, the switch mechanism 16 in the exemplary embodiment contains two switch elements 18. The switch elements 18 are each located on an end of the activation lines 12*a*, 12*b* at the respective distributer node, from which the branches 13 extend.

To activate the switch element 18 the switch mechanism 16 is connected to the control unit 10 via a selection line 20 in the exemplary embodiment. In addition, the receiver unit 8 is connected to a ground potential for the control unit, forming a reference potential, via a ground connection 21, schematically illustrated in FIG. 2. The ground connection 21 is, in particular—as is the case with the activation lines 12*a*, 12 and the selection line 20—an electrical conductor. The individual conductors are typically located within a tube running from the base unit to the receiver unit 8. A switching signal generated by the control unit 10, for example, is transmitted to the switch elements 18 in the switch mechanism 16 via the selection line 20 when in operation.

In the variation illustrated in FIG. 2, aside from the illustrated components, there are no further electrical components.

A further variation is shown in FIG. 3. In this variation, both the receiver 4 as well as the further component 14 are permanently connected to the control unit 10 via the activation lines 12*a*, 12*b*. There is preferably therefore no switch mechanism. The selection of the operating mode, and therefore whether the receiver and/or the further component 14 are activated, then takes place exclusively via the control signal itself. The control signal is formed such that it either acts only on the receiver 4 (e.g. a signal with a higher frequency) or only on the further component 14 (e.g. a (quasi) static signal).

The control signal is preferably configured as a pulsed, modulated control signal. In particular it is configured as a pulse-density modulated control signal. The control unit 10 is configured to generate such a control signal.

To activate the receiver 4, a signal with a higher frequency (short pulse duration of the individual pulses) is provided in particular, and to activate the further component 14, a signal with a significantly lower frequency (long pulse duration of the individual pulses), or a static or quasi-static signal is provided.

During operation, a high frequency control signal for operating the receiver 4 is provided at regular intervals, which converts this high frequency control signal to a desired acoustic sound signal, in particular through a corresponding vibration excitation of a membrane. To activate the further component, the control signal is provided thereto for a certain period of time via the activation lines 12*a*, 12*b* with a significantly lower frequency, and thus with a long pulse duration. A long pulse duration is understood in particular to be a pulse duration of, e.g., longer than 5 ms. The pulse duration is measured in particular such that it is sufficient for switching the further component 14.

By this means, the further component 14 is switched between the two states (open and closed). After switching, the high frequency control signal is again provided for activating the receiver 4.

This embodiment is based on the consideration that the further component 14 is so slow that the further component 14 does not change its state when there is a signal with a higher frequency.

Conversely, when the pulse lasts longer than, e.g., 5 ms or longer than 10 ms, the membrane in the receiver 4 stops vibrating and does not emit an acoustic signal. These long pulses are necessary for switching the further component 14.

There are also filter elements 25*a, b* in a preferred development shown in FIG. 3, each of which are located at an input for the receiver 4 and/or the further component 14. The respective signal portions not intended for the respective components 4, 14 are filtered out via these filter elements 25*a, b*. The filter element 25*a* upstream of the further component 14 is in the form of a low pass filter, and the filter element 25*b* upstream of the receiver 4 is in the form of a high pass filter. Appropriate boundary frequencies for these pass filters basically act as a separating filter for the two components that are to be activated. The separating frequency preferably lies in a range of 50 Hz to 200 Hz.

The upstream filter elements 25 (25*a*, 25*b*) therefore filter the selective effects of the signals on the receiver 4 or the further component 14.

The advantage of the embodiments described herein comprises a multiple use of existing components (activation lines 12*a*, 12*b*, optionally the use of an existing ground line as a reference voltage for the selection line 20, control unit 10). At the same time, the function of the receiver unit 8 is expanded. In particular—in comparison with a separate activation of the receiver 4 and the further component 14 with two lines in each case—fewer lines are needed for activating the receiver unit 8.

The invention is not limited to the exemplary embodiments described above. Instead, other variations of the invention can be derived by the person skilled in the art, without abandoning the subject matter of the invention. In particular, all of the individual features described in conjunction with the exemplary embodiments can also be combined with one another in different ways, without abandoning the subject matter of the invention.

The following is a list of reference numerals used in the above description of the invention with reference to the drawing figures:

1 hearing aid housing
2 microphone
3 signal processor
4 receiver
5 battery
6 hearing aid
8 receiver unit
10 control unit

12 activation line
13 branch
14 further component
15 switch unit
16 switch mechanism
18 switch element
20 selection line
21 ground connection
22 control element
24 semiconductor circuit
25*a* filter elements
25*b* filter elements

The invention claimed is:

1. A hearing device, comprising:
a receiver unit with a receiver; and
a control unit;
two activation lines connecting said control unit with said receiver unit for transmitting a control signal; and
a further component disposed in said receiver unit and connected to said control unit via said two activation lines;
wherein said control unit is configured to transmit a pulse-density modulated control signal via said control lines, and to selectively activate said receiver and said further component via a pulse modulation; and
wherein said control unit is configured to employ a frequency for activating the further component that is lower than a frequency for activating the receiver, and the frequency for activating the further component is a frequency below 1 kHz.

2. The hearing device according to claim 1, wherein said control unit contains a booster amplifier configured to supply power to said receiver and to said further component.

3. The hearing device according to claim 2, configured as a receiver-in-the-canal hearing aid.

4. The hearing device according to claim 1, wherein said further component is a controllable ventilation element.

5. The hearing device according to claim 1, wherein said further component contains a switch unit configured to be switched between two switching states by way of the control signal.

6. The hearing device according to claim 1, wherein said switch unit is a magnetic switch unit.

7. The hearing device according to claim 1, wherein said control unit is connected to said receiver unit exclusively via said two activation lines or via an additional selection line and ground connection.

8. The hearing device according to claim 1, further comprising a filter element connected upstream of at least one of said receiver or said further component and configured to filter out the control signal for the respective other component.

9. The hearing device according to claim 1, further comprising a switch mechanism in said receiver unit configured to activate at least one of said receiver or said further component.

10. The hearing device according to claim 9, wherein said switch mechanism contains two switch elements for electrically connecting either said receiver or said further component to said control unit.

11. A hearing device, comprising:
a receiver unit with a receiver; and
a control unit;
two activation lines connecting said control unit with said receiver unit for transmitting a control signal;
a further component disposed in said receiver unit and connected to said control unit via said two activation lines; and
a filter element connected upstream of said receiver and a filter element connected upstream of said further component and configured to filter out the control signal for the respective other component;
said filter element upstream of said receiver being a high pass filter, and said filter element upstream of said further component being a low pass filter.

12. The hearing device according to claim 11, wherein said control unit is configured to transmit a pulsed control signal via said control lines, and to selectively activate said receiver and said further component via a pulse modulation.

13. The hearing device according to claim 12, wherein the control signal for activating is a pulse-density modulated control signal.

14. The hearing device according to claim 12, wherein said control unit is configured to employ a frequency for activating the further component that is lower than a frequency for activating the receiver.

15. The hearing device according to claim 14, wherein said control unit is configured to employ a frequency below 1 kHz for activating said further component.

16. A method for operating a hearing device, the method comprising:
providing the hearing device with a receiver unit having a receiver and a further component, the hearing device also having a control unit connected to the receiver via two activation lines; and
generating a control signal by said control unit and transmitting the control signal to the receiver unit via the activation lines; and
selectively activating the receiver with the control unit by way of the control signal and activating the further component with the control unit by way of the control signal transmitted via the two activation lines; and
thereby:
activating the further component with the control signal having a frequency below 1 kHz and activating the receiver with the control signal having a frequency that is higher than the frequency of the control signal for activating the receiver;
or filtering the control signal with a filter element connected upstream of the receiver and a filter element connected upstream of the further component, the filter elements filtering out the control signal for the respective other component, with the filter element upstream of the receiver being a high pass filter, and the filter element upstream of the further component being a low pass filter.

* * * * *